US010036182B2

(12) United States Patent
Yoshikawa et al.

(10) Patent No.: US 10,036,182 B2
(45) Date of Patent: Jul. 31, 2018

(54) ELECTRONIC LOCKING SYSTEM

(71) Applicant: NIDEC SANKYO CORPORATION, Suwa-gun, Nagano (JP)

(72) Inventors: Shinichi Yoshikawa, Nagano (JP); Noboru Ashibe, Nagano (JP); Goro Nakamura, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 174 days.

(21) Appl. No.: 15/007,640

(22) Filed: Jan. 27, 2016

(65) Prior Publication Data

US 2016/0215524 A1 Jul. 28, 2016

(30) Foreign Application Priority Data

Jan. 28, 2015 (JP) ..... 2015-014525

(51) Int. Cl.
*E05B 47/00* (2006.01)
*E05B 47/02* (2006.01)

(52) U.S. Cl.
CPC ..... *E05B 47/0012* (2013.01); *E05B 47/0002* (2013.01); *E05B 47/02* (2013.01); *E05B 2047/0065* (2013.01); *E05B 2047/0068* (2013.01); *E05B 2047/0069* (2013.01); *E05B 2047/0073* (2013.01); *E05B 2047/0076* (2013.01); *E05B 2047/0082* (2013.01); *E05B 2047/0087* (2013.01); *E05B 2047/0097* (2013.01)

(58) Field of Classification Search
CPC ..... H02J 7/00; H01H 27/42; E05B 47/0012; E05B 47/02; E05B 2047/0097; E05B 2047/0082; E05B 2047/0073; E05B 2047/0065; E05B 2047/0068; E05B 2047/0069; E05B 2047/0076; E05B 2047/0087; E05B 2047/0002
See application file for complete search history.

(56) References Cited

U.S. PATENT DOCUMENTS 8,344,552 B2 * 1/2013 Cook ..... H01Q 7/00 307/104
2015/0115622 A1 * 4/2015 Burdenko ..... E05B 47/0001 292/138

FOREIGN PATENT DOCUMENTS

JP 2008214872 A 9/2008

* cited by examiner

*Primary Examiner* — Robert Deberadinis
(74) *Attorney, Agent, or Firm* — Cantor Colburn LLP

(57) ABSTRACT

An electronic locking system provided with an electronic lock may include a lock detecting part to detect locking condition of the lock; a power outage-detecting part to detect power outage; a charging part to supply electric power to the lock during power outage; a power-supplying part to supply power to the lock and charging part; and a switching part structured such that power is supplied to the lock from the power-supplying part in a primary state, and power is supplied to the electronic lock from said charging part in a secondary state. The switching part is in said primary state during normal operation where no power outage is detected. The switching part is structured such that, when power outage is detected, said switching part is switched from said primary state to said secondary state.

8 Claims, 2 Drawing Sheets

ELECTRONIC LOCKING SYSTEM

CROSS REFERENCE TO RELATED APPLICATION

The present invention claims priority under 35 U.S.C. § 119 to Japanese Application No. 2015-014525 filed Jan. 28, 2015, the entire content of which is incorporated herein by reference.

FIELD OF THE INVENTION

The present invention relates to an electronic locking system provided with an electronic lock.

BACKGROUND

Conventionally known is an electronic lock which is locked when powered (Patent reference 1, for example). An electronic lock, disclosed in Patent reference 1, is locked when electric power is supplied and unlocked when electric power supply is interrupted. Therefore, when power outage occurs and electric current supply to the electronic lock is interrupted, the lock is automatically unlocked. Conventionally also known is an electronic lock which is unlocked when powered. This type of electronic lock is unlocked when electric power is supplied and locked when electric power supply is interrupted. Therefore, this type of electronic lock is automatically locked when power outage occurs and electric current supply to the electronic lock is interrupted.

PATENT REFERENCE

[Patent Reference 1] Unexamined Japanese Patent Application Publication 2008-214872

As described above, the electronic lock which is locked when powered has an advantage that the lock is automatically unlocked when power outage occurs and therefore power is not supplied. On the other hand, the electronic lock which is unlocked when powered has an advantage that the lock is automatically locked when power outage occurs and therefore electric power is not supplied. However, the electronic lock which is locked when powered constantly consumes electricity while in the locked condition, increasing power consumption. In the same manner, the electronic lock which is unlocked when powered constantly consumes power while in the unlocked condition, increasing power consumption.

Therefore, at least an embodiment of the present invention provides an electronic locking system capable of reducing power consumption while maintaining the advantage of an electronic lock which is locked when powered. Also, at least an embodiment of the present invention provides an electronic locking system capable of reducing power consumption while maintaining the advantage of an electronic lock which is unlocked when powered.

To achieve the above, the electronic locking system of at least an embodiment of the present invention, having an electronic lock which becomes unlocked during the time of power outage, comprises a lock detecting part for detecting that the electronic lock is in the locked condition, a power outage-detecting part for detecting power outage, a charging part for supplying electric power to the electronic lock during the time of power outage, a power-supplying part for supplying electric power to the electronic lock and the charging part, and a switching part which is switched between a primary state, in which electric power can be supplied to the electronic lock from the power-supplying part, and a secondary state, in which electric power can be supplied to the electronic lock from the charging part; wherein the electronic lock is an electronic lock which is instantly locked/unlocked when powered or a motor-driven locking/unlocking type electronic lock; at a normal time where no power outage is detected, the switching part is in the primary state; when the electronic lock is switched from the unlocked condition to the locked condition or from the locked condition to the unlocked condition, electric power is supplied to the electronic lock from the power-supplying part; when power outage is detected based on the detection result at the power outage detecting part and also it is detected based on the detection result by the lock detecting part that the electronic lock is in the locked condition, the switching parties switched from the primary state to the secondary state, power is supplied to the electronic lock from the charging part, and then the electronic lock becomes unlocked.

The electronic locking system of at least an embodiment of the present invention is equipped with the switching part switching between the primary state, in which electric current can be supplied by the electric power-supplying part to the electronic lock, and the secondary state, in which electric current can be supplied to the electronic lock by the charging part. In at least an embodiment of the present invention, also, when power outage is detected based on the detection result at the power outage detecting part and it is detected based on the detection result by the lock detecting part that the electronic lock is in the locked condition, the switching parties switched from the primary state to the secondary state at which power is supplied to the electronic lock by the charging part and the electronic lock becomes unlocked. In other words, in at least an embodiment of the present invention, when power outage is detected and it is also detected that the electronic lock is in the locked condition, the switching parties automatically switched from the primary state to the secondary state, without a user's operation, to supply electric current to the electronic lock from the charging part so that the electronic lock which was in the locked condition when power outage occurred becomes unlocked immediately after the power outage occurs. For this reason, the electronic locking system of at least an embodiment of the present invention has an advantage of an electronic lock which is locked when powered that, when power outage occurs and no electric current is supplied to the electronic lock, the electronic lock automatically becomes unlocked. Also, in at least an embodiment of the present invention, the electronic lock is an electronic lock which is instantly locked/unlocked when powered or a motor-driven locking/unlocking type electronic lock, in which power is consumed when the electronic lock is switched from the unlocked condition to the locked condition or from the locked condition to the unlocked condition. Therefore, in the preset invention, the power consumption by the electronic locking system can be reduced. Thus, in the electronic locking system of at least an embodiment of the present invention, the power consumption by the electronic locking system can be reduced while having the advantage of an electronic lock which is locked when powered.

Also, in at least an embodiment of the present invention, electric power is supplied to the electronic lock from the power-supplying part when the electronic lock is switched from the unlocked condition to the locked condition or from the locked condition to the unlocked condition during normal operation where no power outage is detected by the power-outage detecting part. When power outage is detected and it is also detected that the electronic lock is in the locked condition, electric power is supplied from the charging part. Therefore, in at least an embodiment of the present invention, the charging part charges and discharges less frequently. Therefore, in at least an embodiment of the present invention, the life of the charging part can be increased.

To achieve the above, the electronic locking system of at least an embodiment of the present invention is an electronic locking system equipped with an electronic lock which is kept in the locked condition during the time of power outage, and comprises an unlock detecting part for detecting that the electronic lock is in the unlocked condition, a power outage-detecting part for detecting power outage, a charging part for supplying electric power to the electronic lock during the time of power outage, a power-supplying part for supplying electric power to the electronic lock and the charging part, and a switching part which is switched between the primary state, in which electric power can be supplied to the electronic lock by the electric power-supplying part, and the secondary state, in which electric power can be supplied to the electronic lock by the charging part; wherein the electronic lock is an electronic lock which is instantly locked/unlocked when powered or a motor-driven locking/unlocking type electronic lock; during normal operation where no power outage is detected, the switching part is in the primary state; when the electronic lock is switched from the unlocked condition to the locked condition or from the locked condition to the unlocked condition, electric power is supplied to the electronic lock by the power-supplying part; when power outage is detected based on the detection result by the power outage detecting part and it is also detected, based on the detection result by the unlock detecting part, that the electronic lock is in the unlocked condition, the switching part is switched from the primary state to the secondary state, electric power is supplied to the electronic lock by the charging part, and the electronic lock becomes locked.

The electronic locking system of at least an embodiment of the present invention is equipped with the switching part which is switched between the primary state, in which electric power can be supplied to the electronic lock by the power-supplying part, and the secondary state, in which electric power can be supplied to the electronic lock by the charging part. Also, in at least an embodiment of the present invention, when power outage is detected based on the detection result by the power outage detecting part and it is also detected, based on the detection result by the unlock detecting part, that the electronic lock is in the locked condition, the switching part is switched from the primary state to the secondary state, electric power is supplied to the electronic lock by the charging part, and then the electronic lock becomes locked. In other words, in at least an embodiment of the present invention, when power outage is detected and it is also detected that the electronic lock is in the locked condition, the switching part is automatically switched from the primary state to the second sate without a user's operation so that electric power is supplied to the electronic lock by the charging part; thus, the electronic lock which was in the unlocked condition when power outage occurred becomes locked immediately after the power outage occurs. For this reason, the electronic locking system of at least an embodiment of the present invention has an advantage of an electronic lock which is unlocked when powered, and in which the electronic lock automatically becomes locked when power outage occurs and no electricity is supplied to the lock. Also, in at least an embodiment of the present invention, the electronic lock is an electronic lock which is instantly locked/unlocked when powered or a motor-driven locking/unlocking type electronic lock, in [both of] which electric power is consumed when the electronic lock is switched from the unlocked condition to the locked condition or from the locked condition to the unlocked condition. Therefore, in at least an embodiment of the present invention, power consumption by the electronic locking system can be reduced. As described, in the electronic locking system of at least an embodiment of the present invention, power consumption by the electronic locking system can be reduced while having the advantage of an electronic lock which is unlocked when powered.

Also, in at least an embodiment of the present invention, electric power is supplied to the electronic lock by the power-supplying part when the electronic lock is switched from the unlocked condition to the locked condition or from the locked condition to the unlocked condition during normal operation where no power outage is detected by the power outage detecting part. Also, when power outage is detected and it is also detected that the electronic lock is in the unlocked condition, electric power is supplied to the electronic lock by the charging part. Therefore, in at least an embodiment of the present invention, the charging part charges and discharges less frequently. Thus, the life of the charging part can be increased in at least an embodiment of the present invention.

In at least an embodiment of the present invention, it is preferred that the electronic locking system be equipped with a charging current armature which is wound to be air-cored and connected to a power source and also be equipped with a power-receiving coil, as the power-supplying part, which is wound to be air-cored and arranged opposite the power-supplying coil with a predetermined gap, and that electric power be transmitted from the power-supplying coil to the power-receiving coil through contactless power transmission. With this configuration, there is no need to draw a wire between a fixture to which the electronic lock is mounted and a fixture frame; therefore, the construction of the electronic locking system can be simplified. Meanwhile, when power is supplied through contactless power transmission, efficiency in power transmission is lower than when power is supplied through a wire; therefore, power consumption by the electronic locking system may be greater even if the same amount of electric energy is supplied to the electronic lock or the charging part. However, in at least an embodiment of the present invention, the electronic lock is an electronic lock which is locked/unlocked when powered or a motor-driven locking/unlocking type electronic lock, where electricity is consumed only when the electronic lock is switched from the unlocked condition to the locked condition or from the locked condition to the unlocked condition; therefore, even when electric power is supplied through contactless power transmission, the overall power consumption by the electronic locking system can be reduced.

In at least an embodiment of the present invention, it is preferred that the electronic locking system be equipped with a charge detecting part for detecting that the charging of the charging part is completed, the switching part keep the current-receiving coil and the charging part electrically connected until the charging part is charged completely and then electrically disconnect the current-receiving coil from the charging part as soon as the charge to the charging part is completed, electric power needed to operate the electronic lock and electric power needed to charge the charging part be transmitted from the power-supplying coil to the power-receiving coil when the electronic lock is in operation before the charge to the charging part is completed, and electric power needed to operate the electronic lock be transmitted from the power-supplying coil to the receiving coil when the electronic lock is in operation after the charging of the charging part is completed. With this configuration, the electric power transmitted from the power-supplying coil to the power-receiving coil can be kept to a minimum requirement when the electronic lock is in operation. Therefore, even if the electric power is supplied through contactless power transmission, the overall power consumption by the electronic locking system can effectively be reduced.

In at least an embodiment of the present invention, it is preferred that the electronic locking system be equipped with a charge detecting part for detecting that the charging part is charged completely, the switching part keep the power-receiving coil and the charging part electrically connected until the charging of the charging part is completed and electrically disconnect the power-receiving coil from the charging part as soon as the charging of the charging part is completed, electric power needed to charge the charging part be transmitted from the power-supplying coil and the power-receiving coil when the electronic lock is not in operation before the charging of the charging part is completed, and power transmission from the power-supplying coil to the power-receiving coil is halted when the electronic lock is not in the operation after the charging of the charging part is completed. With this configuration, even if electric power is supplied through contactless power transmission, the overall power consumption by the electronic locking system can effectively be reduced.

EFFECTS OF THE INVENTION

As described above, in the electronic locking system of at least an embodiment of the present invention, power consumption by the electronic locking system can be reduced while having the advantage of an electronic lock which is locked when powered. Alternately, in the electronic locking system of at least an embodiment of the present invention, power consumption by the electronic locking system can be reduced while having the advantage of an electronic lock which is unlocked when powered.

BRIEF DESCRIPTION OF THE DRAWING

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
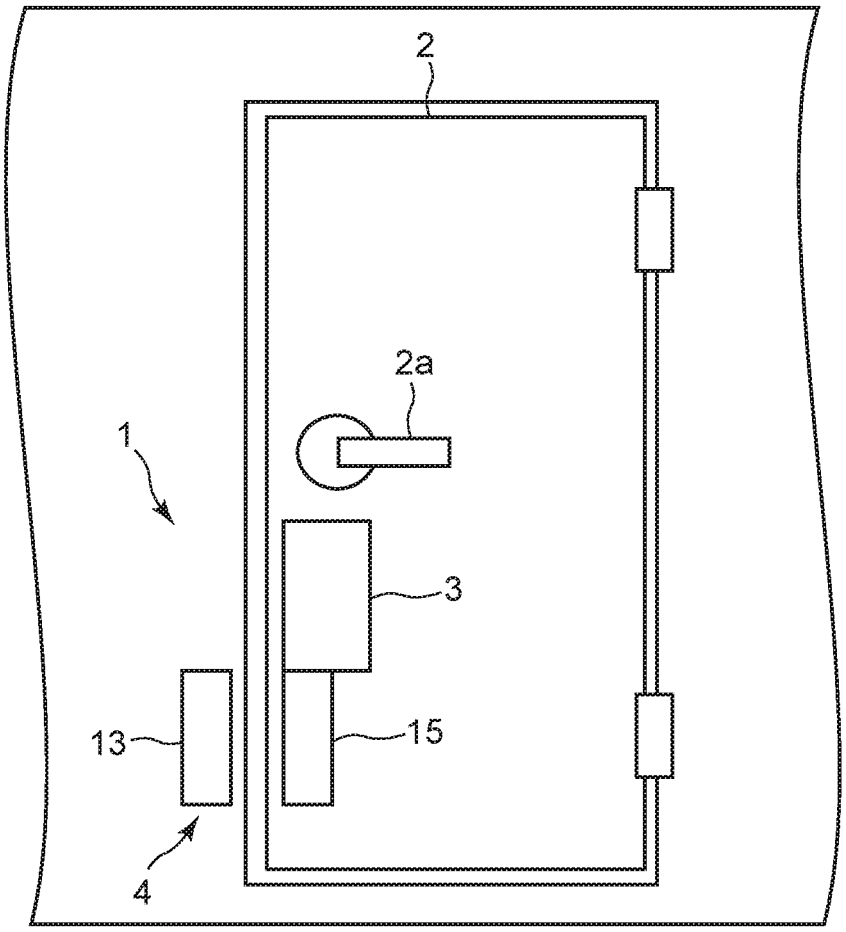
[FIG. 1] A diagram to explain the configuration of an electronic locking system of an embodiment of the present invention.

At least an embodiment of the present invention are described hereinafter, referring to the drawings.

(Configuration of Electronic Locking System)

Figure 2:
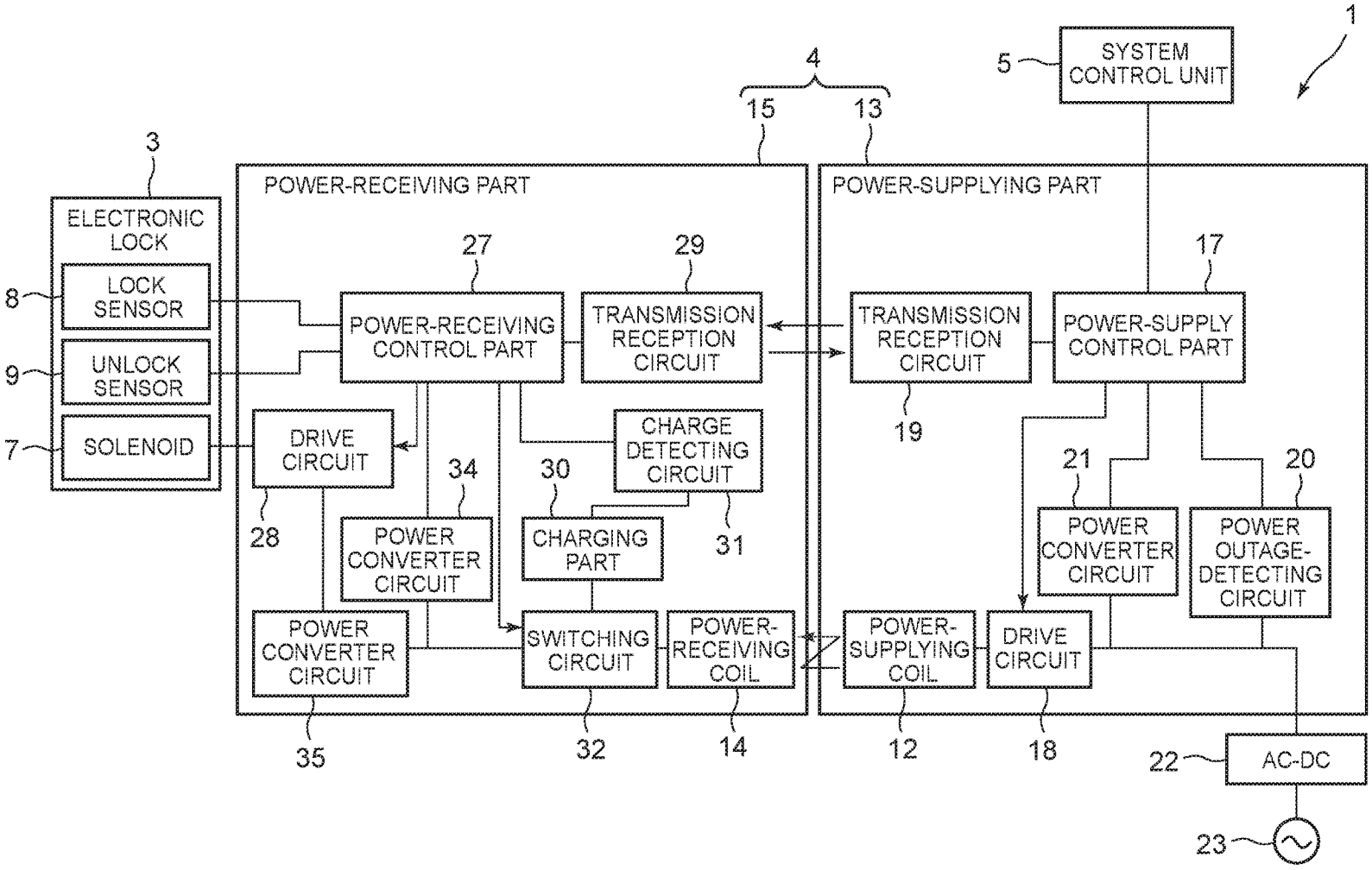
[FIG. 2] A block diagram to explain the electrical configuration of the electronic locking system shown in FIG. 1.

FIG. 1 is a diagram to explain the configuration of an electronic locking system 1 of an embodiment of the present invention. FIG. 2 is a block diagram to explain the electrical configuration of the electronic locking system shown in FIG. 1.

The electronic locking system 1 of this embodiment is a system to lock a door 2 so that the door (a hinged door) 2 will not open, and is equipped with an electronic lock 3, a power-supplying device 4 to power the electronic lock 3, and a system control unit 5 for controlling the electronic locking system. Also, the electronic locking system 1 is equipped with a door open/close sensor (no illustration) for detecting the opened/closed condition of the door 2. A door knob 2*a* is attached to the door 2.

The electronic lock 3 is an electronic lock which is instantly locked/unlocked when powered. In other words, when the electronic lock 3 is switched from the unlocked condition to the locked condition or from the locked condition to the unlocked condition, electric power is supplied tithe electronic lock 3; after the electronic lock 3 is switched from the unlocked condition to the locked condition or from the locked condition to the unlocked condition, power supply to the electronic lock 3 is halted. The electronic lock 3 is provided with a deadbolt (no illustration) and a solenoid 7 which drives the deadbolt. Also, the electronic lock 3 is provided with a lock sensor 8 for detecting that the electronic lock 3 is in the locked condition and an unlock sensor 9 for detecting that the electronic lock 3 is in the unlocked condition. The electronic lock 3 is built in the door 2. The lock sensor 8 of this embodiment is a lock detecting part and the unlock sensor 9 is an unlock detecting part.

The power-supplying device 4 is a wireless type power-supplying device that supplies electric power to the electronic lock 3 (more specifically, the solenoid 7) through contactless power transmission. This power-supplying device 4 is equipped with a power-supplying part 13 having a power-supplying coil 12 and a power-receiving part 15 having a power-receiving coil 14. The power-receiving part 15 is built in the door 2. The power-supplying part 13 is arranged inside of the outside frame to which the door 2 is swingingly mounted or inside of the wall to which the outside frame is fastened. The power-supplying coil 12 and the power-receiving coil 14 are air-cored coils which are wound to be air-cored.

The power-supplying part 13 is equipped with, in addition to the power-supplying coil 12, a power-supply control part 17 for controlling the power-supplying part 13, a drive circuit 18 for supplying electric current to the power-supplying coil 12, a transmission reception circuit 19 for transmitting information with the power-receiving part 15, and a power outage-detecting circuit 20 for detecting power outage. The power-supply control part 17 is connected to the system control unit 5 by a predetermined wiring, and information is transmitted between the power-supply control part 17 and the system control unit 5.

The transmission reception circuit 19 is connected to the power-supply control part 17. The power-supply control part 17 is connected to a power source 23 (more specifically, an AC power source) via a power converter circuit 21 and an analog-to-digital converter (ADC) 22. The power converter circuit 21 converts the power which is supplied by the power source 23 via the ADC 22 into the power for control. Also, the power-supplying part 17 is equipped with a charging part such as a condenser; during the power outage, the power-supply control part 17 performs a predetermined control using the power supplied by the charging part.

The drive circuit 18 is connected to the power-supplying coil 12 as well as to the power source 23 via the ADC 22. In other words, the power-supplying coil 12 is connected to the power source 23 via the drive circuit 18 and the ADC 22. Also, the drive circuit 18 is connected to the power-supply control part 17. Once the current supplying signal output from the power-supply control part 17 is input to the drive circuit 18, the drive circuit 18 supplies electric current to the power-supplying coil 12.

The power outage-detecting circuit 20 is connected to the power-supply control part 17, to which the power outage-detecting signal output from the power outage-detecting circuit 20 is input. Also, the power outage-detecting circuit 20 is connected to the power source 23 via the ADC 22. The power outage-detecting circuit 20 oversees the voltage of the power source 23 which is connected thereto via the ADC 22. Also, the power outage-detecting circuit 20 judges that power outage has occurred when the voltage of the power source 23 drops below a predetermined reference value. In other words, when the voltage of the power source 23 becomes lower than a predetermined reference value, power outage is detected by the power outage-detecting circuit 20. Also, the power outage-detecting circuit 20 judges that power outage has occurred when the voltage of the power source 23 drops below a predetermined reference value and continually stays there for a predetermined period of time. In other words, when the condition in which the voltage of the power source 23 is below a predetermined reference value continues for a predetermined period of time, the power outage-detecting circuit 20 judges [lit: detects] it to be a power outage. The power-outage-detecting circuit 20 of this embodiment is a power outage-detecting part.

The power-receiving part 15 is provided with, in addition to the power-receiving coil 14, a power-receiving control part 27 for controlling the power-receiving part 15, a drive circuit 28 for supplying electric current to the solenoid 7 to drive the drive circuit 28, and a communication circuit 29 for communicating information with the power-supplying part 13. The power-receiving part 15 is also provided with a charging part for supplying electric power to the electronic lock during the power outage and a charge-detecting circuit 31 for detecting that the charging of the charging part 30 is completed. The power-receiving part 15 is further provided with a switching circuit 32 which is switched between the primary state in which power can be supplied to the electronic lock 3 by the power-receiving coil 14 and the secondary state in which power can be supplied to the electronic lock 3 by the charging part 30. The power-receiving coil 14 of this embodiment is a power-supplying part for supplying electric power to the electronic lock 3 and the charging part 30. Also, the charge-detecting circuit 31 of this embodiment is a charge-detecting part, and the switching circuit 32 is a switching part.

The power-receiving coil 14 is positioned opposite the power-supplying coil 12 with a predetermined gap when the door 2 is in the closed position. In the power-supplying device 4, when electric current is supplied to the power-supplying coil 12 with the door 2 closed, the electric power is transmitted to the power-receiving coil 14 from the power-supplying coil 12 through contactless power transmission. In this embodiment, electric power is transmitted from the power-supplying coil 12 to the power-receiving coil 14 by a magnetic field coupling method. A lock sensor 8 and an unlock sensor 9 are connected to the power-receiving control part 27 so that the lock-detecting signal output from the lock sensor 8 and the unlock-detecting signal output from the unlock sensor 9 are to be input thereto. Also, the above-described door open/close senor is connected to the power-receiving control part 27 to which the door open/close signals output from the door open/close sensor are input.

The communication circuit 29 is connected to the power-receiving control part 27. Between the communication circuit 19 and the communication circuit 29, wireless data communication is going on when the door 2 is in the closed position. For instance, data communication is done between the communication circuit 19 and communication circuit 29 through an infrared transmission. The drive signals of the solenoid 7 and the power outage-detecting signals are transmitted from the communication circuit 19 to the communication circuit 29; on the other hand, the lock detecting signals, the unlock detecting signals, the door open/close signals and the charge complete signals which will be described later are transmitted from the communication circuit 29 to the communication circuit 19. In other words, via the communication circuits 19 and 29, the drive signals of the solenoid 7 and the power outage-detecting signals are transmitted from the power supply control part 17 to the power-receiving control part 27, and the lock detecting signals, the unlock detecting signals, the door open/close signals and the charge complete signals are transmitted from the power-receiving control part 27 to the power supply control part 17.

Note that, as described above, the power supply control part 17 is connected to the system control unit 5 so that the drive signals, etc. of the solenoid 7 which are output from the system control unit 5 are input to the power supply control part 17. More specifically described, the drive signals of the solenoid 7 to turn the electronic lock into the locked condition and the drive signals, etc. of the solenoid 7 to turn the electronic lock from the locked condition to the unlocked condition are output from the system control unit 5 and then input to the power supply control part 17. Also, the power supply control part 17 outputs the lock-detecting signals, the unlock-detecting signals and the door open/close signals to the system control unit 5.

The charging part 30 is a secondary battery (a storage battery) or a condenser. The charging capacity of the charging part 30 of this embodiment is relatively small and is charged with the electricity sufficient to drive the solenoid 7 once (that is, the electricity sufficient to turn the electronic lock 3 from the locked condition to the unlocked condition or from the unlocked condition to the locked condition). The charging part 30 is connected to the switching circuit 32. The charge-detecting circuit 31 is connected to the power-receiving control part 27 and also connected to the charging part 30. The charge complete signals, which are output from the charge-detecting circuit 31, are input to the power-receiving control part 27.

The switching circuit 32 is connected to the power-receiving coil 14 and the charging part 30. Also, the switching circuit 32 is connected to the drive circuit 28 via a power converter circuit 35 which will be described later. Further, the switching circuit 32 is connected to the power-receiving control part 27 so that the switching signals to switch the switching circuit 32 from the above-described primary state to the secondary state is output from the power-receiving control part 27 and then input to the switching circuit 32. The switching circuit 32 keeps the power-receiving coil 14 and the charging part 30 electrically connected until the charging of the charging part 30 is completed, and on the other hand, electrically disconnects the power-receiving coil 14 from the charging part 30 after the charging of the charging part 30 is completed. In this embodiment, when the power-receiving coil 14 and charging part 30 are electrically connected, the charging part 30 is also electrically connected to the solenoid 7 via the drive circuit 28 and a power converter circuit 35 which is described later. On the other hand, when the power-receiving coil 14 and the charging part 30 are electrically disconnected from each other, the charging part 30 is also electrically disconnected from the solenoid.

The power-receiving control part 27 is connected to the power-receiving coil 14 via the power converter circuit 34 and the switching circuit 32 so that electric power can be supplied to the power-receiving control part 27 by the power-receiving coil 14 via the power converter circuit 34 and the switching circuit 32. The power converter circuit 34 converts the electric power supplied by the power-receiving coil 14 into the power for control. Also, the power-receiving control part 27 is provided with the charging part such as the condenser; during the time of power outage, the power-receiving control part 27 performs predetermined controls with the electric power supplied from this charging part. Note that, in this embodiment, the electric power can be supplied to the power-receiving control part 27 by the charging part 30.

The drive circuit 28 is connected with the solenoid 7 and also connected to the switching circuit 32 via the power converter circuit 35. The power converter circuit 35 converts the power supplied from the power-receiving coil 14 or from the charging part 30 into the solenoid driving power. Also, the drive circuit 28 is connected to the power-receiving control part 27. Once the drive signal output from the power-receiving control part 27 is input to the drive circuit 28, the drive circuit 28 drives the solenoid 7.

(Operation of Electronic Locking System)

In the electronic locking system 1, the switching circuit 32 is kept in the primary state in which electric power can be supplied to the electronic lock 3 from the power-receiving coil 14 during normal operation where no power outage is detected by the power-outage detecting circuit 20. More specifically described, in the switching circuit 32 under the condition before the charging is completed, the solenoid 7 and the power-receiving coil 14 are electrically connected, the power-receiving coil 14 and the charging part 30 are electrically connected and the solenoid 7 and the charging part 30 are electrically connected. In the switching circuit 32 under the condition after the charging is completed, the solenoid 7 and the power-receiving coil 14 are electrically connected, but the power-receiving coil 14 and the charging part 30 are electrically disconnected and the solenoid 7 and the charging part 30 are electrically disconnected. Note that the charging part 30 can be completely charged in a short time; therefore, when the switching circuit 32 is in the primary state, the solenoid 7 and the power-receiving coil 14 are normally electrically connected, but the power-receiving coil 14 and the charging part 30 are electrically disconnected and the solenoid 7 and the charging part 30 are electrically disconnected.

To operate the electrical lock 3 under this condition, when the system control unit 5 outputs the drive signal of the solenoid 7 and then the drive signal of the solenoid 7 is input to the power-supply control part 17, the current-supply signal is input to the drive circuit 18 from the power-supply control part 17 and finally electric current is supplied to the power-supplying coil 12. Once electric current is supplied to the power-supplying coil 12, the electric power is transmitted from the power-supplying coil 12 to the power-receiving coil 14.

The drive signal of the solenoid 7 which has been input to the power-supply control part 17 is transmitted from the power-supply control part 17 to the power-receiving control part 27 via the communication circuits 19 and 29. The power-receiving control part 27 which has received the drive signal of the solenoid 7 drives the solenoid 7. Once the solenoid is driven, the electronic lock 3 is switched from the locked condition to the unlocked condition or from the unlocked condition to the locked condition. As described above, the switching circuit 32 is in the primary state during normal operation where no power outage is detected by the power-outage detecting circuit 20. In other words, during normal operation where no power outage is detected by the power-outage detecting circuit 20, the switching circuit 32 is in the primary state; therefore, the solenoid 7 is powered by the power-receiving coil 14. In other words, during normal operation where no power outage is detected by the power outage-detecting circuit 20, electric power is supplied to the electronic lock 3 by the power-receiving coil 14 when the electronic lock 3 is switched from the locked condition to the unlocked condition or from the unlocked condition to the locked condition.

In this embodiment, the charging part 30 is being charged when the electronic lock 3 is in operation at a normal time in which no power outage is detected by the power outage-detecting circuit 20; when the electronic lock 3 is in operation before the charging of the charging part 30 is completed, the electric power which is necessary to operate the electronic lock 3 (that is, to operate the solenoid 7) and the electric power which is necessary to charge the charging part 30 is transmitted from the power-supplying coil 12 to the power-receiving coil 14. Also, when the electronic lock 3 is in operation after the charging of the charging part 30 is completed ate normal time in which no power outage is detected by the power outage-detecting circuit 20, the electric power which is necessary to operate the electronic lock 3 is transmitted from the power-supplying coil 12 to the power-receiving coil 14.

The electric energy transmitted from the power-supplying coil 12 to the power-receiving coil 14 varies depending on the electric current supplied to the power-supplying coil 12. Also, the electric current supplied to the power-supplying coil 12 varies depending on the current-supply signal which is input to the drive circuit 18. In this embodiment, the charge complete signal is transmitted from the power-receiving control part 27 to the power-supply control part 17 via the communication circuit 19 and the communication circuit 29 as described above; the power-supply control part 17 generates a current supply signal based on the charge-complete signal and outputs the generated current supply signal to the drive circuit 18. Also, the drive circuit 18 supplies the power-supplying coil 12 with the electric current which is generated responding to the current-supply signal.

Note that, in addition to the charging of the charging part 30 when the electronic lock 3 is in operation or instead of charging the charging part 30 when the electronic lock 3 is in operation, the charging part 30 may be charged when the electronic lock 3 is not in operation (that is, during the non-operating time of the electronic lock 3). In other words, when the electronic lock 3 is not in operation, the electric power necessary to charge the charging part 30 may be transmitted from the power-supplying coil 12 to the power-receiving coil 14. In this case, upon the completion of the charging of the charging part 30, the power transmission from the power-supplying coil 12 to the power-receiving coil 14 is stopped. In other words, when the electronic lock 3 is not in operation after the charging part 30 is charged, the power transmission from the power-supplying coil 12 to the power-receiving coil 14 is stopped.

Also, in the electronic locking system 1, once power outage is detected based on the detection result from the power outage-detecting circuit 20 and it is also detected, based on the detection result by the lock sensor 8,that the electronic lock 3 is in the locked condition, the switching circuit 32 is automatically switched to the secondary state in which electric power can be supplied to the electronic lock 3 by the charging part 30, electric power is supplied to the electronic lock 3 from the charging part 30 and then the electronic lock 3 becomes unlocked. More specifically described, first of all, once power outage is detected, the power outage-detecting signal which has been input to the power-supply control part 17 is transmitted to the power-receiving control part 27 via the transmission reception circuits 19 and 29. Receiving the power outage-detecting signal, the power-receiving control part 27 judges whether the electronic lock 3 is in the locked condition or not; when the electronic lock 3 is in the locked condition, the power-receiving control part 27 outputs the switching signal to the switching circuit 32 and outputs the drive signal to the drive circuit 28.

Having the switching signal input, the switching circuit 32 is switched from the state in which the solenoid 7 and the charging part 30 are electrically disconnected to the state in which the solenoid 7 and the charging part 30 are electrically connected. Also, the drive circuit 28 drives the solenoid 7 with the power supplied from the charging part 30 to switch the state of the electronic lock 3 from the locked condition to the unlocked condition. Note that even when power outage is detected based on the detection result from the power outage-detecting circuit 20, if it is detected based on the detection result by the lock sensor 9 that the electronic lock 3 is in the unlocked condition, the switching circuit 32 keeps the primary state and electric power is not supplied to the electronic lock 3.

(Major Effects of This Embodiment)

As described above, in this embodiment, once power outage is detected based on the detection result from the power-outage detecting circuit 20 and it is also detected, based on the detection result by the lock sensor 8, that the electronic lock 3 is in the locked condition, the switching circuit 32 is automatically switched to the secondary state in which power can be supplied to the electronic lock 3 from the charging part 30, without a user's operation. In other words, once power outage is detected and it is also detected that the electronic lock 3 is in the locked condition, the electronic lock 3 which was in the locked condition when power outage has occurred is instantly driven so that the electronic lock 3 becomes unlocked immediately after power outage. Therefore, the electronic locking system 1 of this embodiment has an advantage of an electronic lock which is locked when powered, and in which the electronic lock 3 automatically becomes unlocked when power outage occurs and therefore power is not supplied to the electronic lock 3. Also, in this embodiment, the electronic lock 3 is a type of an electronic lock which is instantly locked/unlocked when powered, in which electric power is consumed only when the electronic lock 3 is switched from the unlocked condition to the locked condition or from the locked condition to the unlocked condition. For this reason, power consumption by the electronic lock 3 can be reduced. Thus, in the electronic locking system 1 of this embodiment, power consumption of the electronic locking system 1 can be reduced while having the advantage of an electronic lock which is locked when powered.

In this embodiment, when power outage is detected and it is also detected that the electronic lock 3 is in the locked condition, electric power is supplied to the electronic lock 3 by the charging part 30. Therefore, in this embodiment, the charging part 30 is less frequently charged/discharged. Therefore, the life of the charging part 30 can be increased.

In this embodiment, electric power is transmitted from the power-supplying coil 12 to the power-receiving coil 14 through contactless power transmission. In this embodiment, therefore, there is no need to draw a wire between the door 2 and the outer frame to which the door 2 is fastened by a hinge. Thus, installation of the electronic locking system 1 is easy in this embodiment. However, when power is supplied through contactless power transmission, power transmission efficiency is low, compared to the power transmission through wires; therefore, even if the same electric energy is supplied to the electronic lock 3 or the charging part 30, the power consumption by the electronic locking system 1 tends to be greater. However, in this embodiment, the electronic lock 3 is an electronic lock which is instantly locked/unlocked when powered and power is consumed only when the electronic lock 3 is switched from the unlocked condition to the locked condition or from the locked condition to the unlocked condition, power consumption by the electronic locking system 1 can be reduced even if power is supplied through contactless power transmission.

In this embodiment, the electric power necessary to operate the electronic lock 3 and the electric power necessary to charge the charging part 30 is transmitted from the power-supplying coil 12 to the power-receiving coil 14 when the electronic lock 3 is in operation before the charging of the charging part 30 is completed; on the other hand, the electric power necessary to operate the electronic lock 3 is transmitted from the power-supplying coil 12 to the power-receiving coil 14 when the electronic lock 3 is in operation after the charging of the charging part 30 is completed. In other words, in this embodiment, the minimum electric power is transmitted from the power-supplying coil 12 to the power-receiving coil 14 when the electronic lock 3 is in operation. For this reason, in this embodiment, although power is supplied through contactless power transmission, the overall power consumption of the electronic locking system 1 can effectively be reduced.

Note that, as described above, the electric power necessary to charge the charging part 30 may be transmitted from the power-supplying coil 12 to the power-receiving coil 14; in this case, once the charge to the charging part 30 is completed, power transmission from the power-supplying coil 12 to the power-receiving coil 14 is stopped. For this reason, even in this case, power consumption by the electronic locking system 1 can effectively be reduced.

(Other Embodiments)

The above-described embodiment is an example of an embodiment of the present invention, but is not limited to this and can be varyingly modified within the scope of the present invention.

In the above-described embodiment, when power outage is detected based on the detection result at the power outage-detecting circuit 20 and it is also detected based on the detection result by the lock sensor 8 that the electronic lock 3 is in the locked condition, the switching circuit 32 is switched to the secondary state in which power can be supplied to the electronic lock 3 from the charging part 30, the electronic lock 3 is powered by the charging part 30, and the electronic lock 3 becomes locked. Alternatively, for example, when power outage is detected based on the detection result at the power outage-detecting circuit 20 and it is also detected, based on the detection result by the unlock sensor 9, that the electronic lock 3 is in the unlocked condition, the switching circuit 32 may be switched to the secondary state in which power can be supplied to the electronic lock 3 from the charging part 30, electric power is supplied to the electronic lock 3 from the charging part 30, and the electronic lock 3 may become locked.

The electronic locking system 1 in this case has an advantage of an electronic lock which is unlocked when powered, which is automatically locked when power outage occurs and therefore no power is supplied to the electronic lock 3. Also, in this case, power consumption by the electronic locking system 1 can be reduced in the same manner as the above-described embodiment. In other words, the electronic locking system 1 in this case can reduce power consumption by the electronic locking system 1 while having the advantage of the electronic lock which is unlocked when powered. Note that, in this case, even when power outage is detected based on the detection result at the power outage-detecting circuit 20, if it is detected, based on the detection result by the lock sensor 8, that the electronic lock 3 is in the locked condition, the switching circuit 32 remains in the primary state and therefore, no electric power is supplied to the electronic lock 3.

In the above-described embodiment, when the power-receiving coil 14 and the charging part 30 are electrically connected, the charging part 30 is electrically connected to the solenoid 7; when the power-receiving coil 14 and the charging part 30 are electrically disconnected, the charging part 30 and the solenoid 7 are electrically disconnected. Beside this, the switching circuit 32 may be configured such that the electrical connection between the charging part 30 and the solenoid 7 is switchable despite the electrical connection status of the receiving coil 14 with the charging part 30. In this case, when the switching circuit 32 is in the primary state, the power-receiving coil 14 and the electronic lock 3 are electrically connected, but the electronic lock 3 and the charging part 30 are electrically disconnected; when the switching circuit 32 is in the secondary state, the electronic lock 3 and the charging part 30 are electrically connected.

In the above-described embodiment, the charging part 30 is connected to the power-receiving coil 14 via the switching circuit 32; however, the charging part 30 may be connected to the power-receiving coil 14 without going through the switching circuit 32. In this case, the switching circuit which switches the connection of the charging part 30 and the power-receiving coil 14 between the electrically connected condition and the electrically disconnected condition, is arranged between the charging part 30 and the power-receiving coil 14, for example. Also, in the above-described embodiment, when the charging of the charging part 30 is completed, the power-receiving coil 14 and the charging part 30 become electrically disconnected; however, the power-receiving coil 14 and the charging part 30 may electrically remain connected electrically even after the charging of the charging part 30 is completed.

In the above-described embodiment, the electronic lock 3 is provided with the solenoid 7 as a drive source for driving a deadbolt; however, the electronic lock 3 may be provided with a motor as the drive source for driving a dead bolt. In other words, the electronic lock 3 may be a motor-driven locking/unlocking type electronic lock. Even in this case, in the same manner as the above-described embodiment, electric power is supplied to the electronic lock 3 [only] when the lock 3 is switched from the unlocked condition to the locked condition or from the locked condition to the unlocked condition, and the power supply to the electronic lock 3 is stopped after the lock 3 is switched from the locked condition to the unlocked condition or from the unlocked condition to the locked condition. Also, in this case, the charging part 30 is being charged with the electric power which is necessary to drive the motor until the electronic lock 3 is switched from the locked condition to the unlocked condition. Even in this case, the same effect as the above-described embodiment can be obtained.

In the above-described embodiment, the power-supplying part 13 is provided with the power outage-detecting circuit 20 that detects power outage; however, the system control unit 5 or the power-receiving part 15 may be provided with a power outage-detecting circuit which detects power outage. In the above-described embodiment, the electronic locking system 1 is a system to lock the door 2 so that the door won't open; however, the electronic locking system 1 may be a system to lock a fitting, such as a sliding door, a window or a shutter, so it cannot be opened.

In the above-described embodiment, electric power is transmitted from the power-supplying coil 12 to the power-receiving coil 14 by a magnetic field coupling method; however, power may be transmitted from the power-supplying coil 12 to the power-receiving coil 14 by other wireless methods such as an electromagnetic induction method. Also, in the above-described embodiment, the power-supplying device 4 supplies electric power by contactless power transmission; however, the power-supplying device 4 may supply electric power using a power source connected to the switching circuit 32 via a predetermined wiring. In this case, the power source connected to the switching circuit 32 via wiring functions as a power-supplying part to supply electric power to the electronic lock 3 and the charging part 30.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electronic locking system provided with an electronic lock which becomes unlocked at the time of power outage, the electronic locking system comprising:

a lock detecting part structured to detect that said electronic lock is in the locked condition;

a power outage-detecting part structured to detect power outage;

a charging part structured to supply electric power to said electronic lock during the time of power outage;

a power-supplying part structured to supply power to said electronic lock and said charging part; and a switching part structured such that power is supplied to said electronic lock from said power-supplying part in a primary state, and power is supplied to said electronic lock from said charging part in a secondary state;

wherein said electronic lock is an electronic lock which is locked/unlocked when powered or a motor-driven locking/unlocking-type electronic lock;

said switching part is structured to be in said primary state during normal operation where no power outage is detected by said power outage-detecting part, and when said electronic lock is switched from the unlocked condition to the locked condition or from the locked condition to the unlocked condition, electric power is directly supplied to said electronic lock from said power-supplying part without going through said charging part; and said switching part is structured such that, when power outage is detected, based on the detection result at said power outage-detecting part, and it is also detected, based on the detection result by said lock detecting part, that said electronic lock is in the locked condition, said switching part is switched from said primary state to said secondary state, electric power is supplied to said electronic lock from said charging part, and said electronic lock become unlocked.

2. The electronic locking system as set forth in claim 1, further comprising:

a power-supplying coil which is wound to be air-cored and connected to a power source; and power-receiving coil which is wound to be air-cored and arranged opposite said power-supplying coil with a predetermined gap;

wherein electric power is transmitted from said power-suppling coil to said power-receiving coil by contactless power transmission.

3. The electronic locking system as set forth in claim 2, further comprising:

a charge detecting part structured to detect that the charging of said charging part is completed;

wherein said switching part is structured to keep said power-receiving coil and said charging part electrically connected until the charging of said charging part is completed, and electrically disconnect said power-receiving coil from said charging part when the charge to said charging part is completed;

when said electronic lock is in operation before the charging of said charging part is completed, electric power necessary to operate said electronic lock and electric power necessary to charge said charging part is transmitted from said power-supplying coil to said power-receiving coil; and when said electronic lock is in operation after the charge to said charging part is completed, electric power necessary to operate said electronic lock is transmitted from said power-supplying coil to said power-receiving coil.

4. The electronic locking system as set forth in claim 2, further comprising:

a charge detecting part structured to detect that the charge to said charging part is completed;

wherein said switching part is structured to keep said power-receiving coil and said charging part electrically connected until the charging of said charging part is completed, and electrically disconnect said power-receiving coil from said charging part when the charge to said charging part is completed;

when said electronic lock is not in operation before the charging of said charging part is completed, electrical power necessary to charge said charging part is transmitted from said power-supplying coil to said power-receiving coil; and when said electronic lock is not in operation after the charging of said charging part is completed, power transmission from said power-supplying coil to said power-receiving coil is halted.

5. An electronic locking system provided with an electronic lock which becomes locked at the time of power outage, the electronic locking system comprising:

an unlock detecting part structured to detect that said electronic lock is in the unlocked condition;

a power outage-detecting part structured to detect power outage;

a charging part structured to supply electric power to said electronic lock during the time of power outage;

a power-supplying part structured to supply electric power to said electronic lock and said charging part; and a switching part structured such that power is supplied to said electronic lock from said power-supplying part in a primary state, and power is supplied to said electronic lock from said charging part in a secondary state;

wherein said electronic lock is an electronic lock which locked/unlocked when powered or a motor-driven locking/unlocking-type electronic lock;

said switching part is structured to be in said primary state during normal operation where no power outage is detected by said power outage-detecting part, and when said electronic lock is switched from the unlocked condition to the locked condition or from the locked condition to the unlocked condition, electric power is directly supplied to said electronic lock from said power-supplying part without going through said charging part; and said switching part is structured such that, when power outage is detected, based on the detection result at said power-outage detecting part, and it is also detected, based on the detection result at said lock detecting part, that said electronic lock is in the unlocked condition, said switching part is switched from said primary state to said secondary state, power is supplied to said electronic lock from said charging part, and said electronic lock becomes locked.

6. The electronic locking system as set forth in claim 5, further comprising:

a power-supplying coil which is wound to be air-cored and connected to a power source; and power-receiving coil which is wound to be air-cored and arranged opposite said power-supplying coil with a predetermined gap;

wherein electric power is transmitted from said power-suppling coil to said power-receiving coil by contactless power transmission.

7. The electronic locking system as set forth in claim 6, further comprising:

a charge detecting part structured to detect that the charging of said charging part is completed;

wherein said switching part is structured to keep said power-receiving coil and said charging part electrically connected until the charging of said charging part is completed, and electrically disconnect said power-receiving coil from said charging part when the charge to said charging part is completed;

when said electronic lock is in operation before the charging of said charging part is completed, electric power necessary to operate said electronic lock and electric power necessary to charge said charging part is transmitted from said power-supplying coil to said power-receiving coil; and when said electronic lock is in operation after the charge to said charging part is completed, electric power necessary to operate said electronic lock is transmitted from said power-supplying coil to said power-receiving coil.

8. The electronic locking system as set forth in claim 6, further comprising:

a charge detecting part structured to detect that the charge to said charging part is completed;

wherein said switching part is structured to keep said power-receiving coil and said charging part electrically connected until the charging of said charging part is completed, and electrically disconnect said power-receiving coil from said charging part when the charge to said charging part is completed;

when said electronic lock is not in operation before the charging of said charging part is completed, electrical power necessary to charge said charging part is transmitted from said power-supplying coil to said power-receiving coil; and when said electronic lock is not in operation after the charging of said charging part is completed, power transmission from said power-supplying coil to said power-receiving coil is halted.

* * * * *